United States Patent [19]

Blahut

[11] 4,115,845

[45] Sep. 19, 1978

[54] AUTOMATIC LOCKING AND SUPPORT DEVICE FOR HIGH MAST LIGHTING STRUCTURE

[75] Inventor: Edward J. Blahut, Riverside, Ill.

[73] Assignee: Kapcoa Corp., Glenview, Ill.

[21] Appl. No.: 783,433

[22] Filed: Mar. 31, 1977

[51] Int. Cl.[2] ..... F21V 21/14; B42F 13/00

[52] U.S. Cl. ..... 362/403; 362/431; 248/320

[58] Field of Search ..... 240/64, 67, 84; 292/65, 292/341.15, 341.17, 336, 45; 248/123, 125, 316 R, 316 E, 320, 322, 327, 226.3; 362/403, 423, 418, 431

[56] References Cited

U.S. PATENT DOCUMENTS

| | | | |
|---|---|---|---|
| 357,943 | 2/1887 | Stamm | 292/341.17 |
| 468,040 | 2/1892 | Didion | 292/341.17 |
| 2,793,891 | 5/1957 | Frye | 292/341.17 |
| 3,673,403 | 6/1972 | Woods | 240/64 |

*Primary Examiner*—J D Miller
*Assistant Examiner*—Peter S. Wong
*Attorney, Agent, or Firm*—Silverman, Cass & Singer, Ltd.

[57] ABSTRACT

A high mast lighting structure including a hollow mast and a light and reflector or illumination assembly adapted to be raised to the top of the mast by operation of a hoisting cable secured to the assembly. A plurality of latch-type locking and support means are positioned between the illumination assembly and a support plate secured at the top of the mast. Each locking and support means includes a first member mounted to the illumination assembly and comprising a pair of generally planar, oppositely facing spring-loaded bracket or jaw portions which normally rest in substantially parallel position. A second member of each locking and support means comprises a bayonet-like projection having outstanding cam surfaces; the second members are mounted to to the support plate. The said members of the locking and support means are arranged for respective cooperative engagement when the illumination assembly is raised to the top of the mast such that the projection of the second member engages between the jaws of the first member and the cam surfaces spread the jaws; the jaws pass over the cam surfaces and thereafter snap back to rest position to be locked upon the projection thereby to maintain the illumination assembly securely at the top of the mast. The locking members are releasable by raising the illumination assembly a short distance beyond the locking position attained; upon raising the assembly, each projection spreads the jaws of its associated first member to permit a pivotal bar or arm to drop across the jaws and temporarily maintain the same in open position whereby the assembly is released for lowering. As the projection moves away from the jaws during lowering of the assembly, a release finger on the projection disengages the arm and the jaws snap back to rest or re-set position.

21 Claims, 13 Drawing Figures

FIG. 1
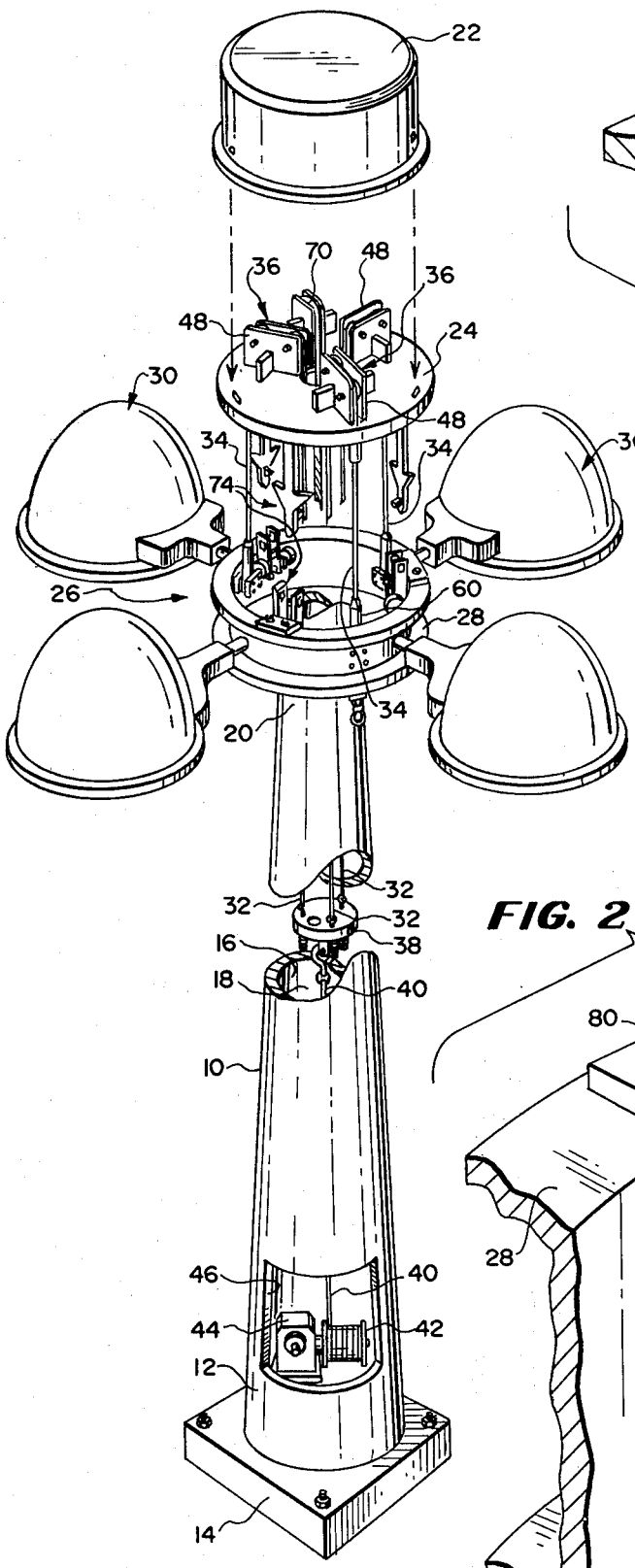
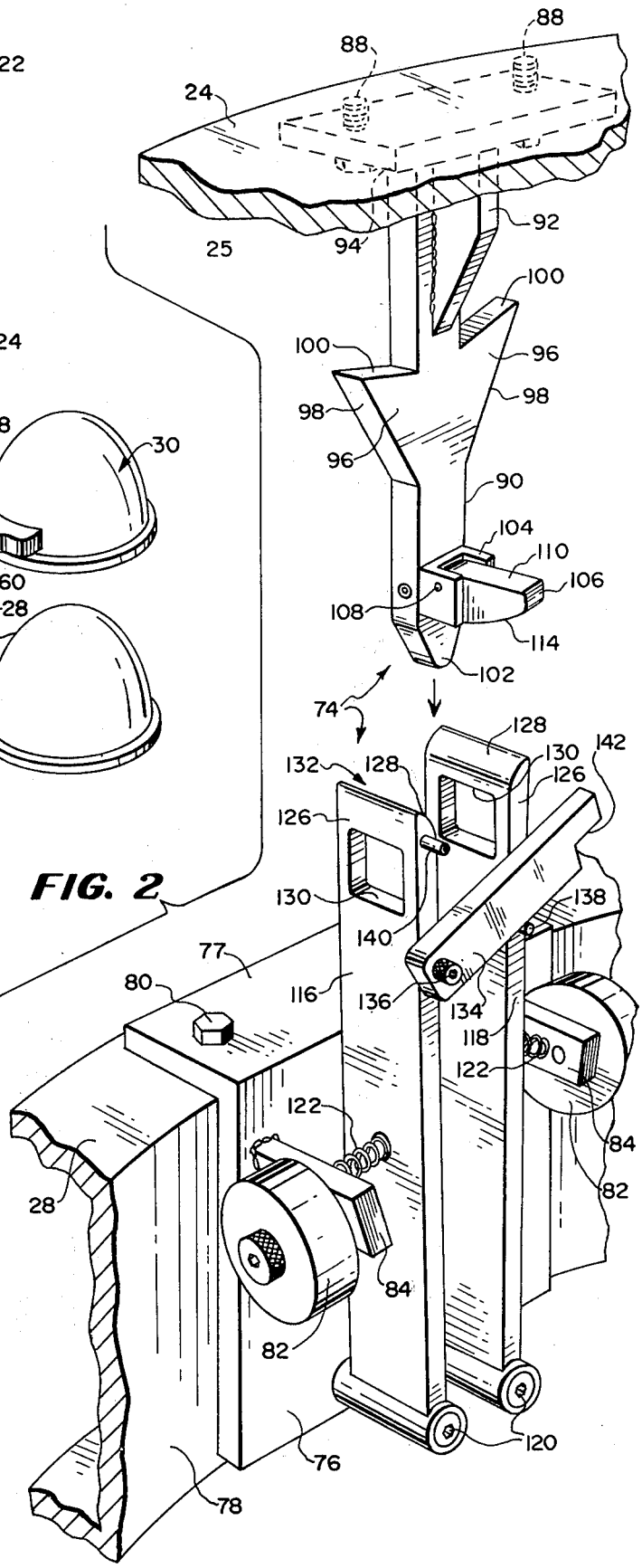
FIG. 2

AUTOMATIC LOCKING AND SUPPORT DEVICE FOR HIGH MAST LIGHTING STRUCTURE

BACKGROUND OF THE INVENTION

1. Field of the Invention

This invention relates generally to high mast lighting structures, and more particularly, to releasable means for locking and supporting an illumination assembly at the top of such structures.

2. Description of the Prior Art

High mast lighting structures are used for area lighting such as in large parking areas, at highway interchanges and the like. These structures generally include a very tall mast with illumination devices mounted at the top thereof. Servicing of the illumination devices and related structure is difficult because of the great height at which these elements are positioned above the ground. For this reason, such structures generally include means to lower the illumination devices to the bottom of the mast so as to enable convenient servicing thereof at ground level. After the illumination devices have been serviced at the bottom of the mast, they must be raised and locked at the top thereof so that the lighting structure may function in accordance with its intended purpose.

Many devices are known to enable raising and lowering of illumination devices and locking thereof at the top of relatively high masts. Such devices generally include elaborate guiding and control arrangements as well as locking means which are operable to raise the illumination device and to secure the same on the mast. Illustrations of such devices are disclosed in U.S. Pat. Nos. 3,801,813 and 3,805,054 which include a cable assembly to raise the illumination device on the mast and latch means to lock the illumination device. A separate cable connected to the latch means is operable at ground level to release the latch so that the illumination device may be lowered. The necessity for a separate latch release cable gives rise to possible tangling of cables in the restricted area within the mast through which the operating cables must pass.

Illustrations of devices which eliminate the need for a separate latch release cable are found in U.S. Pat. Nos. 3,673,403, 3,721,816, 3,856,639 and 3,862,744. These patents disclose locking apparatus which are operable and releasable at the top of a high mast without a separate latch release cable. Generally, the structures involved include cam members which engage latches when the illumination assembly is moved to the top of the mast, and which are disengageable upon a further movement of the illumination assembly by operation of its hoisting cable at the bottom of the mast. The use of camming members to operate latch members gives rise to further operability considerations. Such latch members must be self-centering as the illumination assembly is moved to the top of the mast; they must be relatively insensitive to misalignment to prevent jams is alignment is not exact; they must be operationally reliable and easily serviceable if repair is needed; and they must be of relatively moderate cost to be desirable for inclusion in high mast lighting systems.

The structure of the present invention provides a locking device which is operable without a separate release cable and yet accomplishes the other objectives of such a device.

SUMMARY OF THE INVENTION

The invention is characterized by a plurality of latch-type locking and support means positioned between an illumination assembly and a support plate secured at the top of the mast of a high mast lighting structure. The illumination assembly is moveable up and down the mast by operation of a hoisting cable secured thereto. Each locking and support means includes a first member mounted to the illumination assembly and comprising a pair of oppositely facing spring-loaded jaws or brackets which normally rest in generally parallel position with respect to each other. A second member of each locking and support means is secured to the support plate and comprises a bayonet-like projection having outstanding cam surfaces. The said members of the locking and support means are arranged for cooperative engagement when the illumination assembly is raised to the top of the mast such that the projection engages between the jaws and the cam surfaces spread the same. The jaws pass over the cam surfaces and thereafter snap back to rest position to be locked upon the projection thereby to maintain the illumination assembly securely at the top of the mast with tension on the hoisting cable relieved therefrom. The locking and support means are releasable to permit lowering of the illumination assembly by operation of the hoisting cable and raising the assembly a short distance beyond the locking position attained. Upon raising the assembly, each projection spreads its respective jaws to permit a pivotal arm to drop across the jaws and temporarily maintain the same in open position whereby the assembly is released for lowering. As the projection moves away from the jaws during lowering of the assembly, a pivotal release finger on the projection disengages the arm and the jaws snap back to rest or re-set position.

BRIEF DESCRIPTION OF THE DRAWINGS

FIG. 1 is an exploded perspective of a high mast lighting structure embodying the automatic locking and support means of the invention;

FIG. 2 is an enlarged perspective view of one of the locking and support means of the invention with the same shown prior to engagement of the jaws and projection members thereof;

DESCRIPTION OF THE PREFERRED EMBODIMENT

Figure 3:
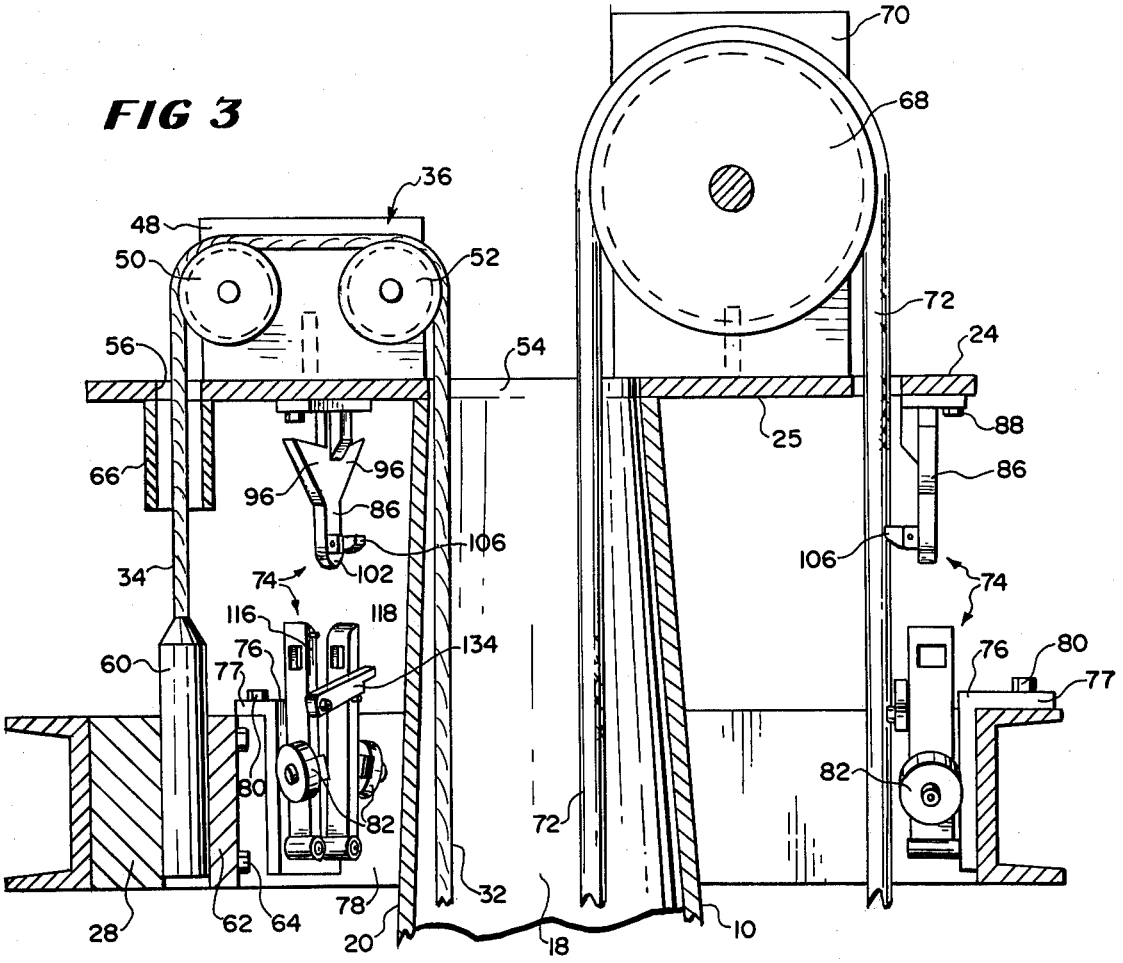
FIG. 3 is a sectional view taken through the mast head of structure of FIG. 1 with the locking and support means shown prior to engagement of the jaws and projection members thereof.

FIG. 1 illustrates a high mast lighting structure of the type with which the locking and support means of the invention is intended for use. A tapered hollow mast 10 with its wider part 12 mounted on a pad 14 is anchored to the ground in any suitable manner. The mast 10 has an interior wall 16 which extends the length thereof and defines the interior space 18 from the pad 14 to the top 20 of the mast.

An enclosure cap 22 is removably positioned upon the top 20 of the mast to protect the operational members to be described which are mounted on a support plate 24 secured to the top of the mast. Also supported by the mast 10 is an illumination assembly 26 including a circular frame 28 upon which light sockets and refectors 30 or the like may be mounted. The assembly 26 encircles and is spaced from the exterior surface of the mast 10.

A plurality of support cables 32, preferably three in number, are connected at the terminal ends 34 thereof to frame 28 of illumination assembly 26 at three equally spaced balance points and extend upwardly therefrom to pass over respective pulley assemblies 36 mounted on the support plate 24. The cables 32 extend downwardly from the pulley assemblies 36 through the interior space 18 of the mast and are secured to a cable coupling member 38 which may function also as a shock absorbing device during raising and lowering of the illumination assembly. A single hoisting cable 40 is secured at one end thereof to the underside of the coupling member 38 and at the other end to a winch drum 42 upon which the hoisting cable is wound. A winch motor 44 coupled to the drum 42 is provided for rotating the drum to raise or lower the illumination assembly on the mast. An opening 46 is provided at the lower end of the mast to enable access to the drum 42 to effect operation thereof.

Each pulley assembly 36 includes a support housing 48 secured to the support plate 24 and a pair of pulley wheels 50, 52 rotatably mounted in the housing. The support plate 24 has a central passageway 54 opening to the interior space 18 of the mast 10 and an aperture 56 associated with each outermost wheel 50. The support cables 32 pass up through the interior space 18, over the wheels 50, 52, and down through the aperture 56 in the plate 24. The terminal end 34 of each cable 32 is fitted with an anchor member 60 which is held to the circular frame 28 of the illumination assembly 26 in any suitable manner such as by blocks 62 and anchor bolts 64. The apertures 56 are provided with guide sleeves 66 to center the circular frame 28 as it is moved to its maximum height at the top of the mast 10; the sleeves 66 are adapted for receipt of the anchors 60 in telescoping relationship.

Support plate 24 also is provided with a pulley wheel 68 mounted in its housing 70 secured to the plate 24 at any suitable location for receipt thereover of an electrical power cable 72 which passes through passageway 54 and to a junction box (not shown) at the base of the mast 10. The power cable 72 is connected at its upper end to the illumination assembly to carry electrical energy from the junction box to the lights mounted thereon.

The structure hereinabove described is that required to raise the illumination assembly 26 to its operating position at the top of the mast 10. At its uppermost position, the assembly 26 is provided with locking and support means 74 to remove tension from the cables 32 and maintain the assembly locked in the operating position until it is desired to release the assembly and lower the same for service thereof.

Each locking and support means 74 comprises a first member 76 including a bracket 77 mounted upon the circular frame 28 on the mast-facing surface 78 thereof by suitable fasteners such as bolts 80. In the preferred embodiment shown there are three locking and support means 74 spaced equi-distantly about the perimeter of the frame 28. Each member 76 is provided with a pair of rollers 82 rotatably mounted on respective support brackets 84 extending toward the surface of the mast 10. The rollers 82 ride along the mast 10 as the illumination assembly 26 is raised or lowered and thereby prevent the assembly from coming in direct contact with the mast and possibly damaging the same.

Each locking and support means 74 also comprises a second member 86 formed in a generally arrowhead configuration; each second member 86 is secured on the underside 25 of support plate 24 by suitable fasteners 88. The second members 86 are spaced about the plate 24 at locations corresponding with those of the first members 76 such that movement of the frame 28 to the top of the mast will cause the second members 86 to come into engagement with the respective first members 76.

The second members include an elongate projection or shank 90 with a support flange 92 formed on a base plate 94. The shank 90 flares out on either side thereof approximately mid-length thereof to form a pair of oppositely facing cam members 96 having projecting inclined camming surfaces 98 and flat locking surfaces 100 which are disposed generally normal to the shank 90. The shank 90 terminates in a reduced dimension blunted tip 102. A generally C-shaped bracket 104 is formed on the shank proximate the tip 102; the bracket 104 carries a release finger 106 pivotally mounted therein by pin 108. The release finger 106 has a top surface 110 and a rear surface 112 formed normal to the top surface 110 which abuts the shank 90 in the normal rest position of the finger 106. The underside of the finger 106 is formed with a generally arcuate surface 114 which is adapted to come in contact with the first member 76 and cause the finger to pivot upwardly as seen in the figures.

Each first member 76 includes a pair of elongate jaws or bracket members 116, 118 pivotally mounted at one end thereof on bracket 77 in face-to-face relationship about pivot pins 120 which are secured to the bracket 77. The bracket members 116, 118 are biased toward each other by springs 122 positioned respectively between the brackets 116, 118 and the roller-mounting brackets 84. Stop pins 124 protrude from the mounting bracket 77 and serve as abutment members against which the brackets 116, 118 are biased by the springs 122 in the rest or closed position of the brackets 116, 118. In said rest position of the brackets 116, 118, the brackets are disposed one with respect to the other at generally parallel orientation.

Each bracket member 116, 118 is formed at its end 126 opposite that pivotally mounted to the support bracket 77 with a rounded cam-riding surface 128 and an opening 130 which in the preferred embodiment is generally square-shaped. The ends 126 of the brackets 116, 118 upon which the cam-riding surfaces 128 are formed together present a mouth portion 132 of the first member 76 which opens toward the second member 86 for engagement thereby. A pivotal arm 134 is secured to bracket 116 at pivot pin 136; a stop pin 138 is positioned on bracket 118 against which the arm 134 is supported in its rest position. A stop pin 140 is positioned near the end 126 of bracket 116 to prevent arm 134 from swinging beyond this point. The arm 134 is formed at its end opposite pivot pin 136 with a notch 142 adapted for engagement with stop pin 138 when the brackets 116, 118 are in their opened or spread position.

Figure 5:
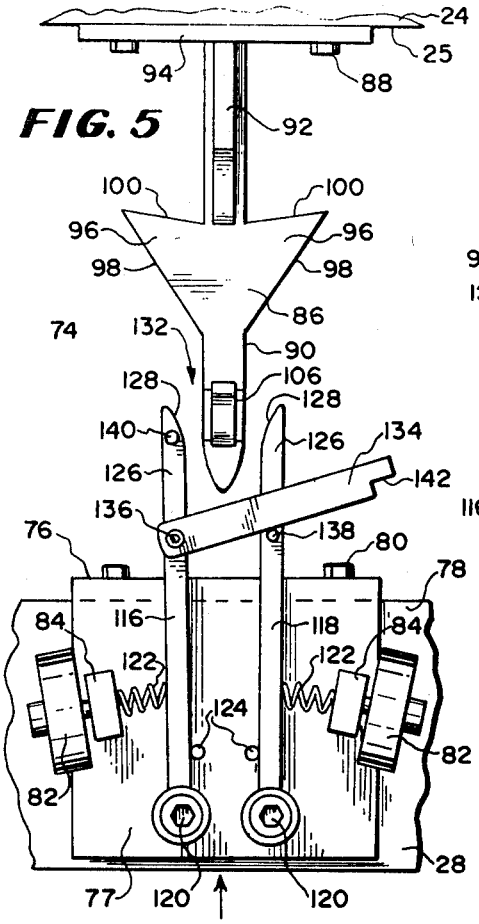
FIG. 5 is an elevational view of one locking and support means in a first stage of operation thereof as the jaws member approaches the projection.
Figure 6:
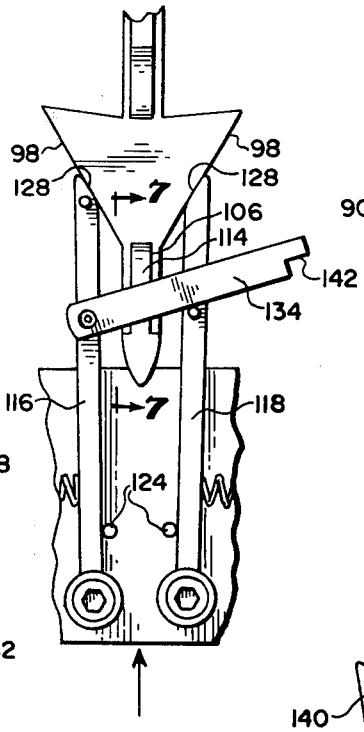
FIG. 6 is a view similar to FIG. 5 with the jaws member shown as it is engaged by the projection.
Figure 7:
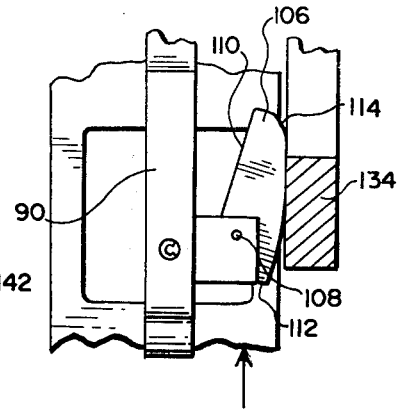
FIG. 7 is a sectional view taken along the line 7—7 of FIG. 6 in the direction indicated generally.
Figure 8:
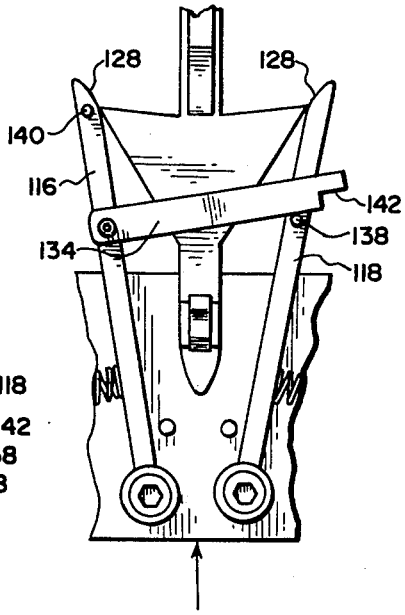
FIG. 8 is a view similar to FIG. 5 with the jaws member shown engaged by the projection and just prior to locking of the two members of the locking and support means.

As stated, it is desired to lock the illumination assembly 26 and support the same at the top of the mast 10 when the assembly has been raised to its uppermost or operating position. The locking and support means 74 accomplishes this purpose in the manner sequentially illustrated in FIGS. 2, 3 and 5 through 13. Assuming the assembly 26 is in its position adjacent ground level for servicing, after the same has been accomplished the operator activates drum 42 upon which cable 40 is wound to raise the assembly toward the top of the mast. As the assembly 26 approaches the support plate 24, the anchor members 60 are received within sleeves 66 to align each locking and support means 74 for engagement of the first and second members 76, 86 thereof (FIGS. 2, 3 and 5). As the assembly 26 is raised further, the camming surfaces 98 of the second members 86 engage the cam-riding surfaces 128 of the respective first members (FIG. 6). The arcuate surface 114 of pivotal release finger 106 engages arm 134 and begins to pivot upwardly (FIGS. 6 and 7) to permit the second member 86 to enter between the brackets 116, 118 of the first member. Further alignment of the first and second members takes place as they engage each other.

Continued movement of the assembly 26 toward the top of the mast causes the camming surfaces 98 to spread the jaws or brackets 116, 118 against the force of the springs 122. The brackets 116, 118 continue to spread until they reach the position illustrated in FIG. 8 at which the arm 134 rests on the stop 138 a short distance from the notch 142. Movement of the assembly 26 a short distance further permits the camming surfaces 98 to enter the openings 130 in the brackets 116, 118; the brackets 116, 118 thereupon snap into their rest position with the cam members 96 engaged within the openings 130. The operator thereupon releases the tension on the cable 140 which permits the assembly 26 to drop a short distance such that the locking surfaces 100 of the second members 86 support the assembly 26 with the perimeter of the openings 130 resting on the locking surfaces 100 (see FIGS. 4 and 9).

Figure 4:
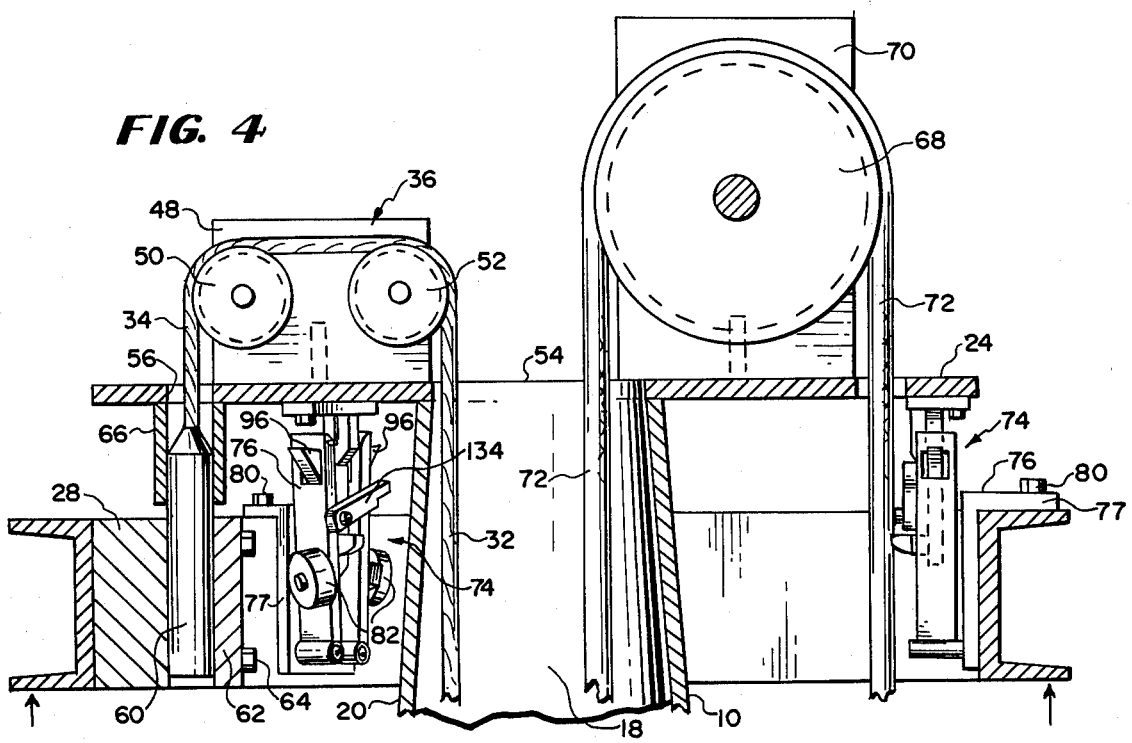
FIG. 4 is a view similar to that of FIG. 3 illustrating the jaws and projection members of the locking and support means in engaged position.
Figure 9:
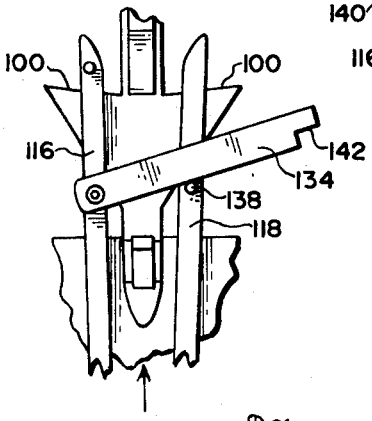
FIG. 9 is a view similar to FIG. 8 with the jaws member shown engaged by the projection and the two members of the locking and support means locked together.
Figure 10:
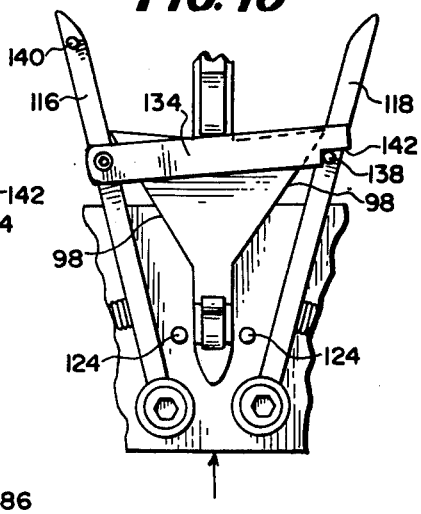
FIG. 10 is a view similar to FIG. 8 showing the relative positions of the jaws and projection members of the locking and support means as the same are moved to disengagement position.

In the condition illustrated in FIGS. 4 and 9, the illumination assembly 26 is locked and supported at the top of the mast. The positive engagement of the locking and support means 74 prevents the assembly 26 inadvertently from falling and tension on the support and hoisting cables is relieved.

Figure 11:
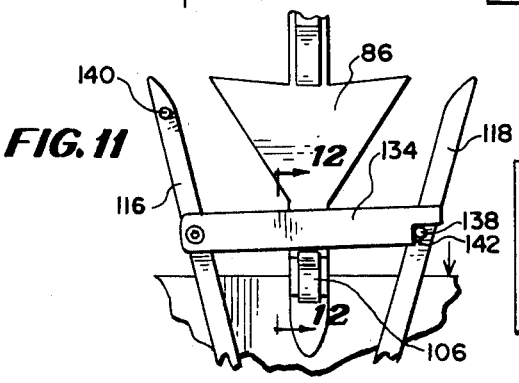
FIG. 11 is a view similar to FIG. 10 showing the members of the locking and support means as they are moved to a further position for disengagement therebetween.
Figure 12:
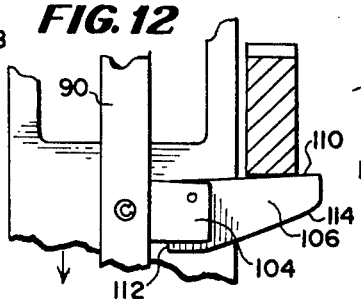
FIG. 12 is a sectional view taken along the line 12—12 of FIG. 11 in the direction indicated generally.
Figure 13:
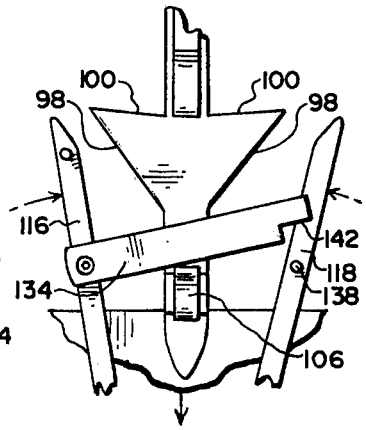
FIG. 13 is a view similar to FIG. 11 showing the members of the locking and support means immediately prior to complete disengagement therebetween.

When it is desired to release the locking and support means 74 to permit lowering of the illumination assembly 26, the operator activates the drum 42 to raise the assembly 26 a short distance. Raising of the assembly 26 causes the camming surfaces 98 to engage the walls of the openings 130 to spread the jaws or brackets 116, 118 to the position shown in FIG. 10. When the brackets 116, 118 are spread to the FIG. 10 position, the notch of arm 134 engages upon stop pin 138 and the brackets 116, 118 are held open and prevented from assuming their closed position. The operator thereupon lowers the assembly 26 causing the second member 86 to move away from the brackets 116, 118 of the first member (FIG. 11). The finger 106 engages the underside of arm 134 (FIG. 12) and, since the finger cannot pivot in a downwardly direction, the arm 134 is lifted to release notch 142 from stop pin 138. In the condition shown in FIGS. 11 and 12 with the finger 106 engaging the arm 134, the cam members 96 are oriented above the openings 130 in brackets 116, 118; thus, release of arm 134 by finger 106 causes the brackets 116, 118 to snap to their rest position after the cam members 96 have cleared the openings 130. This latter condition is shown partially complete in FIG. 13. The second member 86 therefore is released from the first member 76 and the assembly may be lowered to ground level on the mast. After release of the first and second members 76 and 86 they re-assume the orientation of FIG. 5 ready for repeat of the locking operation.

From the above description it will be apparent that the locking and support means 74 of the invention has many advantageous features. The second member 86 of each means is self-centering with respect to the first member 76 and the load of the illumination assembly is equally balanced at each means 74 due to the symmetry of the two members in the direction of pull. The means 74 is relatively insensitive to misalignment due to the shape of the cam members 96, the width of mouth opening 132 and the centering projection arrangement of the second member 86. The locking and support means 74 is very reliable in operation due to the spring load on the bracket members 116, 118 which assures motion of the bracket members when the illumination assembly 26 is moved. Further, the means 74 is constructed to be serviceable at ground level if needed because the moving parts thereof are concentrated on the first member 76 which are mounted on the illumination assembly and can be lowered to ground.

Minor variations in the structure and other variations in the arrangement and size of the various parts of the invention may occur to those skilled in the art without departing from the spirit or circumventing the scope thereof as set forth in the appended claims.

I claim:

1. In a high mast lighting structure including a hollow mast with an interior space extending the length thereof, an equipment carrying assembly having illumination fixtures or the like mounted thereon, the assembly including a frame positioned about the mast and at least one hoisting cable secured to the assembly and passing over the top of the mast and through the interior space to the base of the mast to enable raising or lowering of the assembly on the mast to and from the top thereof by operation of the cable, the invention comprising, locking and support means positioned between the frame and the top of the mast for releasably locking and supporting the frame in its uppermost position on the mast, said locking and support means including a first member secured to the frame and a second member secured to the top of the mast, the first member having a pair of elongate jaws pivotally mounted at one respective end thereof on the frame and disposed in face-to-face relationship, a spring operable on each said jaw to bias the jaws into generally parallel relationship in a first closed position thereof, each jaw having a cam-riding surface formed on the end thereof opposite the end mounted to the frame and an opening therein adjacent the end having said cam-riding surface, the second member including an elongate shank with opposite facing cam members extending therefrom, each cam member having a camming surface and a locking surface formed thereon, whereby movement of the assembly to the top of the mast will cause the second member to contact the first member such that the camming surfaces engage upon the cam-riding surfaces to spread the jaws and permit the cam members to enter the openings in the jaws with the perimeter of the openings resting on the locking surfaces of the cam members to maintain the assembly in locked and supported position on the mast, and release means associated with the locking and support means operable to disengage the first and second members to permit movement of the assembly away from the top of the mast.

2. The invention as claimed in claim 1 in which there are three locking and support means spaced equi-distantly about the mast.

3. The invention as claimed in claim 1 in which the openings in the jaws are of generally square-shaped configuration.

4. The invention as claimed in claim 1 in which said release means comprise an arm pivotally secured to one of said jaws, a stop pin positioned on the other of said jaws for engagement by the free end of the arm when the jaws are moved by said cam members to a second spread position thereof, and a pivotal release finger on the second member operable to disengage the arm from the stop pin when the first and second members are moved away from each other.

5. The invention as claimed in claim 4 in which the cam members are positioned on the shank approximately midlength thereof, and the release finger is positioned on the shank proximate a free end thereof such that when the finger disengages the arm the cam members are positioned clear of the jaw openings.

6. The invention as claimed in claim 4 in which the arm has a notch on the free end thereof for engagement with the stop pin.

7. The invention as claimed in claim 4 in which the release finger is positioned on the shank proximate a free end thereof, said finger having a flat top surface, a rear surface formed normal to the top surface, and an undersurface of generally arcuate configuration.

8. The invention as claimed in claim 7 in which the undersurface of the release finger engages the arm when the first and second members are moved together to pivot the release finger and permit the same to pass the arm.

9. The invention as claimed in claim 8 in which the top surface of the release finger engages and releases the arm from the stop pin when the first and second members are moved away from each other.

10. The invention as claimed in claim 1 in which the camming surfaces extend from and are generally inclined with respect to the shank.

11. The invention as claimed in claim 10 in which the locking surfaces are disposed generally normal to the shank.

12. A device for locking and supporting a structure movable to the top of a mast comprising, a first member secured to the movable structure and a second member secured to the top of the mast, the first member having a pair of elongate jaws pivotally mounted at one respective end thereof on the movable structure and disposed in face-to-face relationship, a spring operable on each said jaw to bias the jaws into generally parallel relationship in a first closed position thereof, each jaw having a cam-riding surface formed on the end thereof opposite the end mounted to the movable structure and an opening therein adjacent the end having said cam-riding surface, the second member including an elongate shank with opposite facing cam members extending therefrom, each cam member having a camming surface and a locking surface formed thereon, whereby movement of the structure to the top of the mast will cause the second member to contact the first member such that the camming surfaces engage upon the cam-riding surfaces to spread the jaws and permit the cam members to enter the openings in the jaws with the perimeter of the openings resting on the locking surfaces of the cam members to maintain the movable structure in locked and supported position on the mast, and release means associated with the locking and support means operable to disengage the first and second members to permit movement of the structure away from the top of the mast.

13. A device as claimed in claim 12 in which the openings in the jaws are of generally square-shaped configuration.

14. A device as claimed in claim 12 in which said release means comprise an arm pivotally secured to one of said jaws, a stop pin positioned on the other of said jaws for engagement by the free end of the arm when the jaws are moved by said cam members to a second spread position thereof, and a pivotal release finger on the second member operable to disengage the arm from the stop pin when the first and second members are moved away from each other.

15. A device as claimed in claim 14 in which the cam members are positioned on the shank approximately mid-length thereof, and the release finger is positioned on the shank proximate a free end thereof such that when the finger disengages the arm the cam members are positioned clear of the jaw openings.

16. A device as claimed in claim 14 in which the arm has a notch on the free end thereof for engagement with the stop pin.

17. A device as claimed in claim 14 in which the release finger is positioned on the shank proximate a free end thereof, said finger having a flat top surface, a rear surface formed normal to the top surface, and an undersurface of generally arcuate configuration.

18. A device as claimed in claim 17 in which the undersurface of the release finger engages the arm when the first and second members are moved together to pivot the release finger and permit the same to pass the arm.

19. A device as claimed in claim 18 in which the top surface of the release finger engages and releases the arm from the stop pin when the first and second members are moved away from each other.

20. A device as claimed in claim 12 in which the camming surfaces extend from and are generally inclined with respect to the shank.

21. A device as claimed in claim 20 in which the locking surfaces are disposed generally normal to the shank.

* * * * *